US006887040B2

(12) United States Patent
Tiemann et al.

(10) Patent No.: US 6,887,040 B2
(45) Date of Patent: May 3, 2005

(54) TURBINE BLADE/VANE

(75) Inventors: Peter Tiemann, deceased, late of Witten (DE); by Iris Oltmanns, legal representative, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 29 days.

(21) Appl. No.: 10/345,967

(22) Filed: Jan. 17, 2003

(65) Prior Publication Data

US 2003/0133802 A1 Jul. 17, 2003

Related U.S. Application Data

(63) Continuation-in-part of application No. 09/622,596, filed on Sep. 12, 2001, now Pat. No. 6,533,544.

(30) Foreign Application Priority Data

Jan. 17, 2002 (EP) ..... 02001267

(51) Int. Cl.[7] ..... F01D 9/00
(52) U.S. Cl. ..... 415/191; 415/209.3
(58) Field of Search ..... 415/191, 209.4, 415/210.1, 211.2, 209.3, 210

(56) References Cited

U.S. PATENT DOCUMENTS

| | | | | |
|---|---|---|---|---|
| 2,500,745 A | | 9/1944 | Bloomberg | |
| 3,610,769 A | | 10/1971 | Schwedland | |
| 3,807,892 A | | 4/1974 | Frei et al. | |
| 4,283,822 A | | 8/1981 | Muth et al. | |
| 4,987,736 A | | 1/1991 | Ciokajlo et al. | |
| 5,076,049 A | | 12/1991 | Von Benken et al. | |
| 5,249,418 A | | 10/1993 | Finn | |
| 5,396,763 A | | 3/1995 | Mayer et al. | |
| 5,440,874 A | | 8/1995 | Charier et al. | |
| 5,820,336 A | | 10/1998 | Hashimoto | |
| 6,375,415 B1 | * | 4/2002 | Burdgick | 415/115 |
| 6,533,544 B1 | * | 3/2003 | Tiemann et al. | 415/191 |
| 6,558,115 B2 | * | 5/2003 | Tiemann | 415/115 |
| 2001/0018020 A1 | | 8/2001 | Tiemann | |

FOREIGN PATENT DOCUMENTS

| | | |
|---|---|---|
| DE | 26 28 807 | 1/1977 |
| DE | 26 43 049 | 4/1977 |
| EP | 0 550 126 | 7/1993 |
| GB | 1 289 435 | 9/1972 |
| GB | 1 605 219 | 10/1975 |
| GB | 1 605 309 | 10/1975 |
| GB | 1 516 757 | 9/1976 |
| WO | 99/54597 | 4/1999 |

* cited by examiner

*Primary Examiner*—Ninh H. Nguyen
(74) *Attorney, Agent, or Firm*—Harness, Dickey & Pierce, P.L.C.

(57) ABSTRACT

A turbine blade/vane includes a profiled blade/vane aerofoil, which extends along a blade/vane axis to be capable of absorbing high thermal and mechanical loading, on the one hand, and to ensure a comparatively economical consumption of coolant, on the other. For this purpose, the blade/vane aerofoil includes, integrally formed on it, a hot-gas platform extending transversely to the blade/vane axis and, above it, a load platform. A mechanical connection between the load platform and the hot-gas platform occurs exclusively by way of the blade/vane aerofoil.

20 Claims, 1 Drawing Sheet

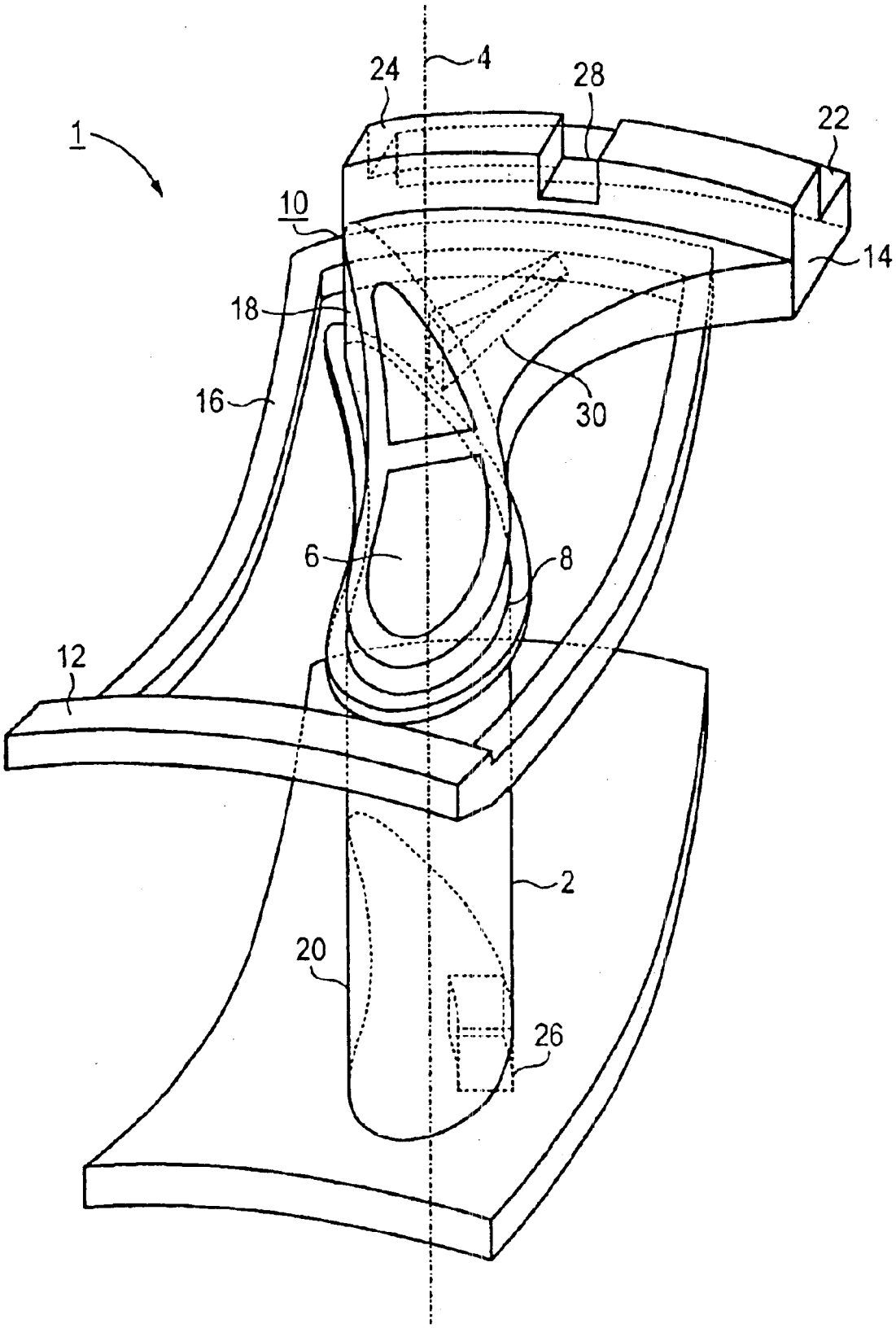
1
4
24
28
22
10
14
18
16
30
6
8
12
2
20
26

TURBINE BLADE/VANE

The present application is a continuation-in-part of application Ser. No. 09/622,596, now U.S. Pat. No. 6,533,544, filed on Sep. 12, 2001. The present application claims priority under 35 U.S.C. §120 on U.S. application Ser. No. 09/622,596, now U.S. Pat. No. 6,533,544.

FIELD OF THE INVENTION

The invention generally relates to a turbine blade/vane, preferably to one having a profiled blade/vane aerofoil, which extends along a blade/vane axis.

BACKGROUND OF THE INVENTION

Gas turbines are employed in many fields for driving generators or operational machines. In this case, the energy content of a fuel is used to generate a rotational motion of a turbine shaft. For this purpose, the fuel is burnt in a combustion chamber, compressed air being supplied by an air compressor. The working medium, which is generated in the combustion chamber by the combustion of the fuel and which is at high pressure and high temperature, is then guided via a turbine unit connected downstream of the combustion chamber and expands, while performing work, in this turbine unit.

In order to generate the rotational motion of the turbine shaft, a number of turbine blades are arranged on the turbine shaft. These blades are usually combined into blade groups or blade rows and drive the turbine shaft via a transfer of momentum from the flow medium. In order to conduct the flow medium within the turbine unit, furthermore, guide vane rows connected to the turbine casing are usually arranged between adjacent rows of turbine blades. In this arrangement, the turbine blades/vanes, in particular the guide vanes, usually have a profiled blade/vane aerofoil extending along a blade/vane axis for the appropriate conduction of the working medium. In order to fasten the turbine blade/vane to the respective support body, a platform extending transversely to the blade/vane axis and embodied as an engagement base is integrally formed at the end of the blade/vane aerofoil.

In order to achieve a particularly favorable efficiency, such gas turbines are usually designed, for thermodynamic reasons, for particularly high outlet temperatures—approximately 1200° C. to approximately 1300° C.—of the working medium flowing out of the combustion chamber and into the turbine unit. With such high temperatures, the components of the gas turbine, in particular the turbine blades/vanes, are subjected to comparatively high thermal loading. In order to ensure a high degree of reliability and a long life of the respective components, even under such operating conditions, the components affected are usually embodied in such a way that they can be cooled.

In consequence, the turbine blades/vanes are usually embodied as so-called hollow profiles in modern gas turbines. For this purpose, the profiled blade/vane aerofoil has cavities, also referred to as blade/vane core, in its interior region; a coolant can be conducted within these cavities. Exposure of the thermally particularly loaded regions of the respective blade/vane aerofoil to coolant is made possible by the coolant ducts formed in this way. In this arrangement, a particularly favorable cooling effect, and therefore a particularly high level of operational reliability, can be achieved by the coolant ducts taking up a comparatively large spatial region within the respective blade/vane aerofoil and by the coolant being conducted as close as possible to the respective surface exposed to the hot gas. On the other hand, in order to ensure adequate mechanical stability and load-carrying capability in such a configuration, the respective turbine blade/vane can have flow through it in a plurality of ducts, a plurality of coolant ducts. These ducts can be exposed to coolant and are respectively separated from one another by comparatively thin separating walls, being provided within the blade/vane profile.

For efficiency reasons, it can be desirable to design such a turbine blade/vane for a comparatively low consumption of coolant. It is precisely in the case where the turbine blade/vane is exposed to comparatively hot working medium that reliable cooling of the individual components of the turbine blade/vane with only limited consumption of coolant can often only be achieved by way of a comparatively thin-walled embodiment of the individual components, with a comparatively small amount of material being required. It is precisely the thermal stresses produced in individual components of the turbine blade/vane during operation of the gas turbine and the substantial mechanical loading which likewise occurs, which can lead to material fatigue or even material fracture. This may require the use, which is actually undesirable, of comparatively thick-walled structural parts, for which a correspondingly complicated cooling system with correspondingly increased supply of coolant then has to be made available.

SUMMARY OF THE INVENTION

An embodiment of the invention is therefore based on an object of providing a turbine blade/vane which is capable of absorbing high thermal and mechanical loading, on the one hand, and ensures a comparatively economical consumption of coolant, on the other.

This object may be achieved, according to an embodiment of the invention, by the blade/vane aerofoil, having integrally formed on it in an end region a hot-gas platform extending transversely to the blade/vane axis and, above it, a load platform, a mechanical connection between the load platform and the hot-gas platform taking place exclusively by means of the blade/vane aerofoil.

An embodiment of the invention may be based on the consideration that even in the case of a turbine blade/vane which is capable of absorbing high thermal loading, the consumption of coolant necessary for reliable cooling can be kept comparatively low by keeping the structural parts substantially thin-walled. In order to make this possible without appreciable danger of material damage, even considering the comparatively high mechanical loading on the turbine blade/vane, the absorption of thermal load by the turbine blade/vane should be kept consistently separate from the absorption of mechanical load. For this purpose, two platform segments are integrally formed on the blade/vane aerofoil, of which one, namely the hot-gas platform, is designed exclusively for absorbing the thermal loading and another, namely the load platform, is designed exclusively for absorbing the mechanical loading.

In this arrangement, the hot-gas platform can be kept particularly thin-walled precisely because, by design, it is subjected to practically no mechanical loading. On the other hand, the load platform, which should have a sufficiently thick-walled embodiment in order to absorb the mechanical loading, is screened by way of the hot-gas platform from direct thermal exposure to the working medium and can therefore be kept to a safe operating temperature without appreciable consumption of coolant, even in the case of a comparatively solid embodiment. A high level of operational reliability can be achieved with such an arrangement precisely because the hot-gas platform, with its comparatively thin-walled embodiment, is kept consistently free of the occurrence of thermal stress. In order to prevent the occurrence of thermal stresses, the hot-gas platform should be able to expand, as far as possible, freely so that, even in the case of alternating thermal loading, no stresses can occur due to thermally induced expansion or contraction. An embodiment of the hot-gas platform with free expansion of this type can be achieved because it is kept mechanically decoupled, as far as possible, from the load platform.

In this arrangement, the hot-gas platform is, by design, kept essentially free of mechanical loading. In order to make this possible, the load platform is advantageously designed in such a way, particularly with respect to its dimensioning, that it is suitable for fully absorbing the forces caused by a working medium flowing around the blade/vane aerofoil.

The turbine blade/vane can be made available with particularly low manufacturing and material outlay. This is because, in an advantageous embodiment, the load platform is limited, with respect to its shaping, to the structural components necessary for a mechanical fixing arrangement matched to the specified boundary conditions. Such an embodiment with minimalized design is favored because the load platform is advantageously integrally formed on an edge of the blade/vane aerofoil which is at the outlet flow end with respect to a working medium.

In this arrangement, the rear edge of the blade/vane aerofoil, viewed in the flow direction of the working medium, is widened in the attachment region to the load platform. It is substantially possible in the front region of the blade/vane aerofoil, viewed in the flow direction of the working medium, to dispense with structural components involving high material outlay for the load platform.

In a particularly advantageous embodiment, mechanical fixing of the turbine blade/vane via the load platform is limited to a minimum of the fixing points necessary for static definition. For this purpose, the load platform advantageously has a rib integrally formed on it for radial engagement and a rib placed on the first rib for axial engagement. In such an embodiment, a single contact point in the axial direction is sufficient for producing the static definition in full on the inside of the turbine blade/vane. A device for preventing rotation in the radial direction and/or a peripheral fixing arrangement on the outside of the turbine blade/vane can, if required, be additionally provided; these can be realized by appropriate means integrally formed on the respective rib, such as grooves or lugs.

The turbine blade/vane is preferably embodied as a guide vane for a gas turbine, in particular for a stationary gas turbine.

The advantages achieved by embodiments of the invention reside, in particular, in the fact that, due to the reduction of the mechanical connection between the load platform and the hot-gas platform to a connection which is exclusively by way of the blade/vane aerofoil, a consistent separation of the structural part provided for absorbing the thermal loading from the structural part provided for absorbing the mechanical loading is made possible. The respective structural parts, namely the hot-gas platform, on the one hand, and the load platform on the other, can therefore be designed specifically for their actual application purpose. It is possible, in particular, to design the hot-gas platform so that it can expand freely and so that it is comparatively thin-walled.

In addition, the hot-gas platform, on the one hand, and the load platform on the other, may also be embodied completely independently of one another with respect to their shaping. It is possible, in particular, for the hot-gas platform to have a width and shape which are different from those of the load platform. In this arrangement, it is possible, in the manner of a minimal solution, for the shaping of the load platform to be tailored in full to the requirements of force transmission, it being possible to cut back on superfluous structural regions in this manner. In addition to a high capability for absorbing thermal loading, which is also aided by the hot-gas platform, this additionally makes it possible to achieve particularly low manufacturing outlay with only low material consumption.

BRIEF DESCRIPTION OF THE DRAWINGS

An exemplary embodiment of the invention is explained in more detail using a drawing. In this, the FIGURE shows a turbine blade/vane in an oblique view.

DETAILED DESCRIPTION OF THE PREFERRED EMBODIMENTS

The turbine blade/vane 1 in the FIGURE has a profiled blade/vane aerofoil 2 which extends along a blade/vane axis 4. In this arrangement, the blade/vane aerofoil 2 is domed and/or curved in order to appropriately influence a working medium flowing in an associated turbine unit.

The turbine blade/vane 1 is embodied as a guide vane for a gas turbine. In order to permit use of the turbine blade/vane 1 even in the case of comparatively high temperatures of the working medium, from approximately 1200° C. to 1300° C., the turbine blade/vane 1 is embodied in such a way that it can be cooled. For this purpose, the blade/vane aerofoil 2 is embodied in the manner of an internal profile with a cavity 6, via which a coolant, for example cooling steam, can be conducted.

A platform system 10 is integrally formed on an end region 8 of the blade/vane aerofoil 2. In this arrangement, the platform system 10 is embodied to absorb both the thermal loading due to the working medium and the mechanical loading due to the working medium. In order, in this arrangement, to permit the high level of mechanical reliability of the overall system with a relatively low coolant consumption, even in the case of high thermal loading, the platform system 10 is configured for a consistent structural separation of thermally loaded components from mechanically loaded components.

For this purpose, the platform system 10 includes, on the one hand, a hot-gas platform 12 and, on the other, a load platform 14. The load platform 14 is kept substantially independent of the hot-gas platform 12. In this arrangement, the hot-gas platform 12 is provided to absorb the thermal loading. The load platform 14 is arranged on the side of the hot-gas platform 12 facing away from the flow space for the working medium and is therefore arranged so that it is located above the hot-gas platform. The hot-gas platform 12 therefore acts in the manner of a heat shield for the load platform 14. In consequence, there is no thermal loading on the load platform 14 due to heat convected in the working medium.

Both the hot-gas platform 12 and the load platform 14 are connected mechanically exclusively to the blade/vane aerofoil 2. No direct mechanical connection, for example by way of transverse struts or support plates, is provided between the load platform 14 and the hot-gas platform 12. The hot-gas platform 12 is therefore embodied so that it can expand substantially freely at its peripheral edge 16, which has a thickened embodiment suitable for a self-supporting structure, without it being possible for restrictions in this respect to occur due to the load platform 14. In the case of alternating thermal loading on the hot-gas platform 12 and lateral expansions or contractions induced by this, thermal stresses induced by this are therefore kept particularly small.

The load platform 14, which has only comparatively slight thermal loading because of the thermal screening due to the hot-gas platform 12 and which can therefore be comparatively easily cooled to a reliable operating temperature, is designed for fully absorbing the forces acting on the blade/vane aerofoil 2 due to the working medium. It therefore has a comparatively thick-walled embodiment. With regard to its shaping, however, the load platform 14 is designed, in the manner of a minimalized embodiment, for a comparatively small number of mechanical fixing points, substantially dispensing with further structural components. For this purpose, the load platform 14 is integrally formed merely on the outlet flow edge 18 of the blade/vane aerofoil 2, viewed with respect to the flow direction of the working medium in the associated turbine unit. On the front edge 20 of the blade/vane aerofoil 2 (viewed in the flow direction of the working medium), on the other hand, there is no continuing extension on its upper end 8 for the formation of a structural element associated with the load platform 14.

In order to form a radial engagement, the load platform 14 is drawn out into a rib 22, on which is placed a rib 24 for axial engagement. In order to complete the engagement in the axial direction, furthermore, a fixing peg 26 is placed on the inside of the turbine blade/vane 1, which fixing peg 26 presents a further contact point in the axial direction. A groove 28 is then left free in the rib 24 provided for the formation of the axial engagement. This groove 28, for the purpose of forming a peripheral fixing arrangement, can be brought into engagement with a structural element integrally formed on the associated turbine casing. In order to complete the engagement in the radial direction, it is additionally possible to provide a radial rib arrangement 30, which is only indicated in the exemplary embodiment.

The turbine blade/vane 1 has, therefore, a hot-gas platform 12 and a load platform 14 which are mechanically decoupled from one another as far as possible. In consequence, the shaping of the load platform 14 can be matched specifically to the specified requirements without associated thermal disadvantages having to be accepted. The thermal loading, on the other hand, is fully absorbed by the hot-gas platform 12, whose shaping, in turn, can be executed completely independently of the load platform 14.

List of Designations

1 Turbine blade/vane
2 Blade/vane aerofoil
4 Blade/vane axis
6 Cavity
8 End region
10 Platform system
12 Hot-gas platform
14 Load platform
16 Peripheral edge
18 Edge at the outflow end
20 Front edge
22,24 Ribs
26 Fixing peg
28 Groove
30 Radial rib arrangement The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A turbine blade/vane, comprising:

a profiled blade/vane aerofoil, extending along a blade/vane axis and on which are integrally formed, in an end region, a hot-gas platform extending transversel to the blade/vane axis and, above it, a load platform, wherein a mechanical connection between the load platform and the hot-gas platform is exclusively formed by the blade/vane aerofoil.

2. The turbine blade/vane as claimed in claim 1, wherein the load platform is designed to absorb forces which are caused by a working medium flowing around the blade/vane aerofoil.

3. The turbine blade/vane as claimed in claim 2, wherein the load platform is integrally formed on an edge of the blade/vane aerofoil, the edge being at the outlet flow end with respect to a working medium.

4. The turbine blamed/vane as claimed in claim 3, wherein the load platform includes a rib intergrally formed on it for radial engagement and a rib placed on the first rib for axial engagement.

5. The turbine blade/vane as claimed in claim 2, wherein the load platform includes a rib integrally formed on it for radial engagement and a rib placed on the first rib for axial engagement.

6. The turbine blade/vane as claimed in claim 1, wherein the load platform is integrally formed on an edge of the blade/vane aerofoil, the edge being at the outlet flow end with respect to a working medium.

7. The turbine blade/vane as claimed in claim 6, wherein the load platform includes a rib integrally formed on it for radial engagement and a rib placed on the first rib for axial engagement.

8. The turbine blade/vane as claimed in claim 1, wherein the load platform includes a rib integrally formed on it for radial engagement and a rib placed on the first rib for axial engagement.

9. The turbine blade/vane as claimed in claim 1, which is embodied as a guide vane for a gas turbine.

10. The turbine blade/vane as claimed in claim 1, which is embodied as a guide vane for a stationary gas turbine.

11. A guide vane for a gas turbine, comprising the turbine blade/vane as claimed in claim 1.

12. A guide vane for a stationary gas turbine, comprising the turbine blade/vane as claimed in claim 1.

13. A turbine blade/vane, comprising:

a blade/vane aerofoil, extending along a blade/vane axis; and a hot-gas platform extending transversely to the blade/vane axis, integrally formed on the blade/vane aerofoil; and a load platform, wherein a mechanical connection between the load platform and the hot-gas platform is exclusively formed by the blade/vane aerofoil.

14. The turbine blade/vane as claimed in claim 13, wherein the load platform is designed to absorb forces which are caused by a working medium flowing around the blade/vane aerofoil.

15. The turbine blade/vane as claimed in claim 13, wherein the load platform is integrally formed on an edge of the blade/vane aerofoil, the edge being at the outlet flow end with respect to a working medium.

16. The turbine blade/vane as claimed in claim 13, wherein the load platform includes a rib integrally formed on it for radial engagement an a rib placed on the first rib for axial engagement.

17. The turbine blade/vane as claimed in claim 13, which is embodied as a guide vane for a gas turbine.

18. The turbine blade/vane as claimed in claim 13, which is embodied as a guide vane for a stationary gas turbine.

19. A guide vane for a gas turbine, comprising the turbine blade/vane as claimed in claim 13.

20. A guide vane for a stationary gas turbine, comprising the turbine blade/vane as claimed in claim 13.

* * * * *